United States Patent [19]

Riethmiller

[11] Patent Number: 4,505,478

[45] Date of Patent: Mar. 19, 1985

[54] GOLFER'S AID

[76] Inventor: Mark R. Riethmiller, 122 Moonlight Ter., San Antonio, Tex. 78233

[21] Appl. No.: 396,495

[22] Filed: Jul. 8, 1982

[51] Int. Cl.[3] ..... A63B 67/02

[52] U.S. Cl. ..... 273/32 H; 283/34; 273/176 L

[58] Field of Search ..... 273/32 H, 409, 176 L; 434/162, 195; 283/34; 40/352

[56] References Cited

U.S. PATENT DOCUMENTS

| | | | |
|---|---|---|---|
| D. 146,786 | 5/1947 | Camp et al. | 273/409 X |
| 289,032 | 11/1883 | Sears | 273/409 |
| 1,147,749 | 7/1915 | Plato | 283/34 |
| 2,024,421 | 12/1935 | Bicker | 273/409 |
| 3,204,343 | 9/1965 | Pollock | 434/195 |
| 3,739,739 | 6/1973 | Brase | 40/352 X |
| 3,805,411 | 4/1974 | Andrews | 273/176 L |
| 3,820,786 | 6/1974 | Candor | 273/32 H |
| 4,173,082 | 11/1979 | Niquette | 434/162 |

*Primary Examiner*—George J. Marlo

*Attorney, Agent, or Firm*—Merchant, Gould, Smith, Edell, Welter & Schmidt

[57] ABSTRACT

A device for estimating distances of consequence to a golf player on a golf hole from substantially any point thereon is disclosed which incorporates an aerial photographic representation of a golf hole and a visual scale measure superimposed thereon comprising alternating light and dark transparent concentric circular bands centered at the hole green. The width of the bands is constant and corresponds to a predetermined unit of measurement on said scale representation.

20 Claims, 2 Drawing Figures

14
17
25
26
23
18
21
22
19
24
16
21
21
15
0
0
0

GOLFER'S AID

TECHNICAL FIELD

The invention is directed to a device which may be used by golfers in determining the distance to the center of the green from any point on a golf hole or from a point to any geographical feature of consequence to the golfer.

BACKGROUND OF THE INVENTION

A particularly difficult problem that confronts golfers is estimating the distance from the golfer's ball to the green and other features which control play prior to each shot. Distance to these points or across certain obstacles determines club selection, and without an accurate determination of this distance, club selection is merely a guess on the part of a player. If the guess is wrong, even where the line of travel is accurate, the shot will be either too short or too long and thus prevent an optimum score.

The problem is particularly acute where the golfer is not familiar with the golf course. Each golf hole is unique in layout and topographical features. If a golfer plays the same course a number of times, he or she becomes aware of these unique features and is able to utilize different landmarks or features relative to his or her own capability and to do a relatively satisfactory job in club selection from various points on the course.

However, on a course where the golfer has never played, or simply is not overly familiar with course layout, distance, features and the like, his or her score will likely be much higher simply from the inability to accurately determine the distance from the golf ball to the target area on each shot.

SUMMARY OF THE INVENTION

The inventive golf hold distance measuring device is the result of an endeavor to provide the golfer with some means to determine with accuracy distances of interest to the golfer from any point on a golf hole, particularly where the golfer has never played a particular golf course.

The invention is based on the use of a scale depiction or representation of each hole on a golf course, and using a scale measure superimposed on the scale representation which permits interpolation of distance to green and other features from any point on the hole.

More particularly, the preferred embodiment comprises an aerial photograph taken at an elevation which is chosen to permit the photographing of each hole on a single picture with sufficient detail to recognize each topographical feature. If the photograph is taken at a known elevation, a scale measure based on that elevation can be adopted and used on each hole. If the photographs of all holes are taken at the same elevation, the same scale measure can be used uniformly for all golf hole representations.

Topographical features of the golf hole including the fairway, tee, green, sand traps and trees may be color enhanced for easy interpretive description. Geographical features of necessary consequence, which are obscure on the photograph may be graphically enhanced.

The scale measure of the inventive device comprises a plurality of concentric bands superimposed on the aerial photograph, each band comprising inner and outer boundaries defined by at least segments of two unique circles, the centers of which lie at the center of the green. In the preferred embodiment, the bands are of predetermined, uniform width and utilize an alternating light and dark pattern superimposed on the aerial photograph in a transparent manner so that the various topographical features of the hole may easily be seen.

The light and dark bands are preferably uniformly distributed over the entire area depicted which encompasses a particular golf hole representation from tee to green. Width of the bands not only is the same but also has been chosen to permit multiples thereof to be calculated easily by mental process without resorting to complex mental arithmetic or to a calculating device. In the preferred embodiment, the band width is ten yards.

Since the light and dark bands are transparently superimposed over the entire aerial photograph, the golfer may readily ascertain the location of his ball relative to unique topographical features of the hole as viewed on the scale representation and quickly interpolate the distance to green by observing the number of bands between the hole and the green.

Preferably, the device also includes numerical indicia disposed in connection with selected bands, permitting the calculation to be relative to the closest band which includes such indicia.

In the preferred embodiment, eighteen scale representations corresponding to the eighteen holes of a golf course are included in a spiral bound booklet with each page having a representation on each side. The booklet is easily carried by the golfer, and reference may be made to it at any time to quickly and easily interpolate distance to the green or any other geographical feature of consequence to the golfer from any point on any golf hole.

BRIEF DESCRIPTION

FIG. 1 is a perspective view of a multiple-page booklet, each page including a representation of a golf hole embodying the invention; and FIG. 2 is a top plan view of one of the inventive golf hole representations shown in the booklet of FIG. 1.

DETAILED DESCRIPTION OF THE INVENTION

Figure 2:
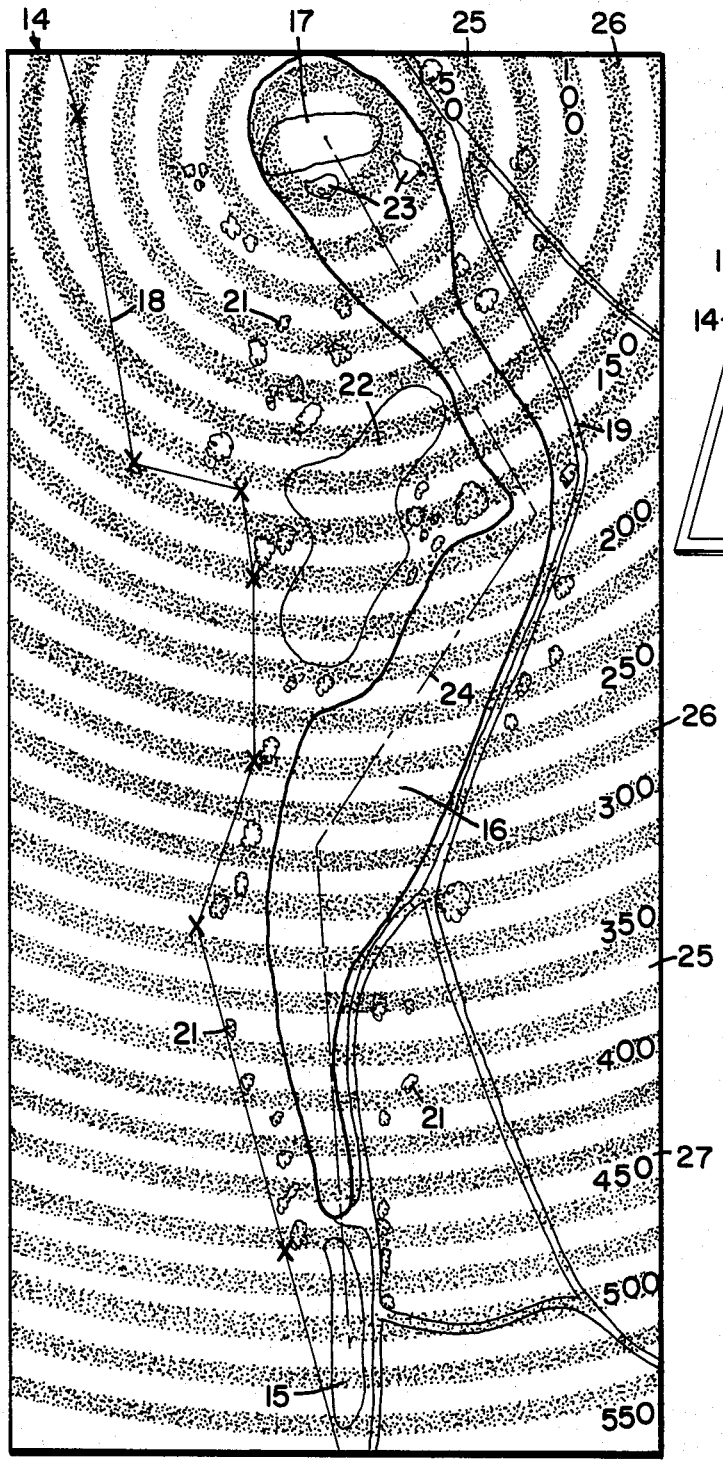

With reference to the figures, a multiple-page booklet 11 is shown to comprise a plurality of rectangular leaves 12 of identical size suitably connected in loose-leaf fashion along one edge. In the preferred embodiment, a spiral connector 13 is used to commonly connect the several leaves 12 along a shorter edge so that the leaves may be easily flipped for access to a desired page.

The leaves 12 are preferably made from material capable of lasting for a period of time even with frequent use. Because the booklet 11 is intended for outdoor use and may be subjected to rain, the invention contemplates moisture proof or resistant leaves 12. In the preferred embodiment, the leaves 12 are made from light cardboard with a suitable moisture proof covering or layer, or from thin plastic.

Each of the leaves 12 includes at least one representation of a golf hole, which is represented generally by the numeral 14. To include eighteen of the representations 14 in the booklet 11, it is preferred that each leaf 12 have a representation 14 on the frontside and backside so that the booklet 11 comprises nine leaves 12 defining eighteen pages, together with a suitable title page. In addition, the booklet may include a general legend leaf and instruction page. As constructed in this manner, two sequentially oriented golf holes may be viewed with the booklet 11 open to a particular position.

It is also possible to include a single golf hole representation 14 on the front side or page of one leaf 12, with a description of the hole or various related points of interest on the backside of this same leaf 12.

With specific reference to FIG. 2, each representation 14 comprises a scale depiction of a golf hole. This depiction may be a graphic illustration which is accurately drawn to scale, but in the preferred embodiment it comprises an aerial photograph of each golf hole which is taken at a predetermined known elevation in order to be able to establish a distance relationship between the various topographical features of the golf course.

In the aerial photographic representation 14 of FIG. 2, the golf hole comprises an elongated tee area 15, and a fairway 16 which includes a dogleg to the left from the golfer's perspective as it approaches a green 17.

The golf hole includes a boundary 18 along the leftside, which may consist of suitable out of bounds markers, or a fence or the like. A road 19 runs along the right side of the golf hole and serves as the righthand boundary.

The aerial photograph also shows a plurality of trees 21 over the length of the hole over both sides of the fairway 16, a large water hazard 22 taking the form of a lake couched in the dogleg, and sand traps 23 in front of and adjacent the green 17.

It will be apparent that the aerial photograph making up the representation 14 may include other topographical features and obstacles on the golf hole, depending on the nature of the golf hole.

The various topographical features of the golf hole may be color enhanced on the scale representation 14. Further, geographical features of necessary consequence which are obscure on the aerial photograph may also be graphically enhanced.

Also in the preferred embodiment, a preferred approach line 24 is superimposed along the fairway 16 from the tee area 15 to the green 17 to advise the golfer of the best approach from tee to green. The golf hole represented in FIG. 2 is on the order of 500 yards in length, and the approach line 24 includes three segments each representing distance and direction of a golf shot. In the preferred embodiment, the approach line 24 extends to the essential center of the green, it being recognized that placement of the golf cup is itself moved from time to time to various points on the green 17 which are not necessarily at its center.

A visual scale measure is superimposed on the representation 14, as shown in FIG. 2, the scale measure comprising a plurality of concentric alternating light and dark bands 25, 26. Each of the concentric bands comprises inner and outer boundaries defined at least by segments of two unique and concentric circles.

The bands 25, 26, being concentric, have a common center disposed at the center of the green 17, and they extend over the entirety of the representation 14. Preferably, the bands 25, 26 extend from at least a region proximate the green 17 over the length of the golf hole to the tee area 15. It is possible for the bands 25, 26 to extend over a lesser portion of the golf hole and still permit estimation to the green from the first fairway shot, for example.

The bands 25, 26 fall into three categories. The first band, which is darker, forms a complete circle, and it is possible on different golf holes for two or more bands to completely encircle the green. The second group of bands define major segments of circles, some of which traverse one or both of the boundaries 18, 19, and some of which traverse neither. The third category of bands 25, 26 are minor segments of circles, and because of their increased radii traverse both of the boundaries 18, 19.

Preferably, the bands 25, 26 are of the same band width, and this band width is of such dimension that it may be expressed in units of measure that are typically used on golf courses; e.g., yards. Further, this band width is chosen so that multiples of the unit of measure may easily be calculated by the golfer through elementary counting procedure without resort to calculating devices. The bands 25, 26 have a width of ten yards in the preferred embodiment. In addition to having a constant band width, the bands 25, 26 are distributed uniformly over the entirety of the representation 14 in the preferred embodiment.

Indicia 27 are placed on the representation 14 at certain distances from the center of the green 17 to specifically identify the distance from the inner boundary of a particular band 25 or 26 to the center of the green. Preferably, the indicia 27 are expressed in yards at fifty yard intervals over the entire length of the golf hole.

The bands 25, 26 are superimposed on the golf hole representation 14 to be transparent or substantially transparent, avoiding visual obstruction of any of the topographical features of the golf hole. This may be done by any conventional printing process, or by superimposing a laminate bearing the bands 25, 26 over the representation 14.

As constructed, it will be appreciated that the golfer simply turns the pages 12 of the booklet 11 to the representation 14 of the golf hole he is about to play, enabling him to initially review the various topographical features and obstacles of the hole and determine a desired line and distance for the first golf shot. Should certain hazards confront him from tee, such as the water hazard 22, the golfer may count the bands to the hazard, determine its distance, and select a club which will drive his ball safely short of the hazard. Once this shot is taken, the golfer, through the use of the representation 14, can quickly and easily ascertain with substantial accuracy the point at which his or her golf ball lies on the course, and may interpolate through the use of the light and dark bands 25, 26 the distance of his or her ball to the green. For example, it may be necessary to interpolate the distance one must fly the ball to successfully clear the water hazard 22 should the golfer choose to attempt to cross the lake.

Where the bands 25, 26 extend uniformly over the length of the entire golf hole, as is the case in the preferred embodiment, it is possible to determine point-to-point distances from virtually any area encompassed by the aerial photograph.

The previous difficulty of determining with accuracy the critical distances needed are overcome through the use of a scale representation 14 in which the distance between topographical features may be determined based on knowledge of the scale, and the inclusion of the concentric light and dark bands 25, 26, which in the preferred embodiment are of constant band width and uniformly distributed over the entire golf hole, serving as a scale measure with which distances may be easily interpolated from any point on the golf hole.

What is claimed is:

1. A device for estimating distances of consequence to a golf player on a golf hole from substantially any point thereon, comprising:

An aerial photographic representation of a golf hole including a tee area, a green and other topographical features thereof;

a first and second plurality of substantially transparent concentric circular bands disposed in an alternating light and dark sequence and superimposed on said representation, each band comprising inner and outer boundaries respectively defined by at least segments of two circles, the centers of which lie at a point on the green on said representation, said plurality of bands being uniformly distributed over at least a portion of the length of the golf hole representation beginning at an area proximate the green thereof, wherein the width of all of said bands is substantially constant and said band width corresponds to a predetermined unit of measurement on said representation;

and indicia means on said representation associated with selected concentric bands for identifying the respective representative distances from said selected concentric bands to the center of the green.

2. The apparatus defined by claim 1, wherein said bands are uniformly distributed over the entire length of said golf hole representation from the green to the tee thereof.

3. The device defined by claim 1, wherein said band width is conformed to a distance of ten yards on said representation.

4. The device defined by claim 1, wherein the indicia means comprise a plurality of numbers each of which is disposed on a selected band and is representative of the distance to the center of the green from the boundary of said band which is nearest the green.

5. The device defined by claim 4, wherein said numbers are positioned at intervals corresponding to multiples of 50 yards from the tee area of said scale representation.

6. The device defined by claim 1, wherein the indicia means comprises a plurality of numbers each of which is associated with a selected concentric band and is representative of the distance to the green from said band.

7. The device defined by claim 6, wherein each number is expressed in predetermined units, each unit being a multiple of the lowest of said units.

8. The device defined by claim 1, wherein the topographical features of said golf hole representation comprise external boundary representations extending longitudinally along the side of the golf hole representation.

9. The device defined by claim 8, wherein said concentric bands comprise first, second and third groups;

the first group comprising one or more complete circles immediately adjacent the representation of the golf hole green;

the second group comprising a plurality of major circular segments disposed next adjacent the first group and radially outward thereof;

and the third group comprising minor circular segments each of which traverses both of the longitudinal boundary representations of the golf hole on said scale representation, the third group being disposed next adjacent the second group and radially outward thereof.

10. The device defined by claim 1, which further comprises a line extending from the tee to the green on said representation, said line representing a recommended line of approach for the golf hole.

11. The device of claim 1 wherein said bands are superimposed on said representation by a printing process.

12. The device of claim 1 wherein said representation comprises a laminate bearing said bands.

13. A booklet for use by golfers in estimating the distance to the green or any other geographical feature of consequence to the golfer from substantially any point on any of a plurality of golf holes, comprising:

a booklet comprising a plurality of leaves;

each leaf having at least one aerial photographic representation thereon of one of said golf holes comprising a tee area, a green and other topographical features thereof;

a plurality of substantially transparent concentric bands disposed in an alternating light and dark sequence and superimposed on said representation, each band comprising inner and outer boundaries respectively defined by at least segments of two circles, the centers of which lie at a point on the green on said representation, said plurality of concentric bands being uniformly distributed over at least a portion of the length of the golf hole representation beginning at an area proximate the green thereof wherein the concentric bands are of constant width and said width corresponds to a predetermined unit of measurement on said representation;

and indicia means on said scale representation associated with selected bands for identifying the respective representative distances from said selected band boundaries to the center of the green.

14. The booklet defined by claim 13, wherein the leaves are of substantially the same size and commonly connected along one edge.

15. The booklet defined by claim 14, wherein the leaves are connected in looseleaf fashion.

16. The booklet defined by claim 13, wherein each leaf defines front and back faces each face having a representation of a different golf hole thereon.

17. The booklet defined by claim 16, which comprises at least nine leaves and eighteen representations.

18. The booklet defined by claim 17, wherein the leaves are substantially identical in size and rectangular in configuration, and further comprising connector means commonly connecting the leaves along one edge thereof in looseleaf fashion.

19. The booklet defined by claim 13, wherein said band width is conformed to a distance of ten yards on said representation.

20. The booklet defined by claim 19, wherein the indicia means comprises a plurality of numbers each of which is disposed on a selected band and is representative of the distance to the green from said inner band boundary.

* * * * *